United States Patent [19]

Seibert

[11] 4,410,147

[45] Oct. 18, 1983

[54] WINDING MACHINE FOR WINDING STRAND-SHAPED WINDING MATERIAL ON A SPOOL

[76] Inventor: Gerhard Seibert, Putzendoplergasse 3, Vienna A-1232, Austria

[21] Appl. No.: 276,290

[22] Filed: Jun. 22, 1981

[30] Foreign Application Priority Data

Jun. 27, 1980 [DE] Fed. Rep. of Germany ..... 3024094

[51] Int. Cl.[3] ..... B65H 54/28

[52] U.S. Cl. ..... 242/158 R; 242/25 R; 242/158.4 R

[58] Field of Search ..... 242/158 R, 158 B, 158 F, 242/158.2, 158.4 R, 158.4 A, 25 R, 7.15, 7.16

[56] References Cited

U.S. PATENT DOCUMENTS

| | | | |
|---|---|---|---|
| 3,257,087 | 6/1966 | Kriete | 242/158.4 R |
| 3,498,567 | 3/1970 | Baker et al. | 242/158.4 R |
| 3,815,846 | 6/1974 | Biewer | 242/158 R |
| 3,951,355 | 4/1976 | Morioka et al. | 242/158.4 R X |
| 3,997,128 | 12/1976 | Hara et al. | 242/158.4 R |
| 4,150,801 | 4/1979 | Ikegami et al. | 242/158 R |
| 4,235,394 | 11/1980 | Fry | 242/158.4 R X |
| 4,283,020 | 8/1981 | Bauer | 242/158.4 R X |

*Primary Examiner*—Stanley N. Gilreath
*Attorney, Agent, or Firm*—Martin A. Farber

[57] ABSTRACT

A control device for obtaining a uniform or even winding is provided for a winding machine for winding strand-shaped winding material, and includes an electrical scanning device which detects the transition from a winding layer into a next higher winding layer by detecting the step that is formed during such transition. The scanning device does not make physical contact with the winding layer but relies on detection information furnished by opto-electrical or acousto-electrical sensing elements. This information is used to control the reversing of movement of a feed drive which effects the relative reciprocating traversing movement between the spool and a strand guide.

8 Claims, 11 Drawing Figures

Fig. 3
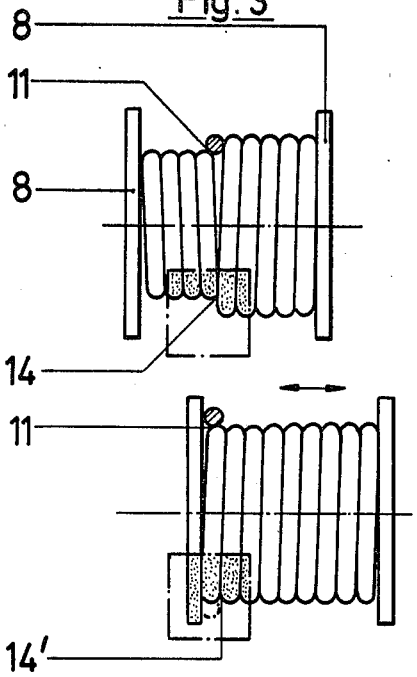
Fig. 4
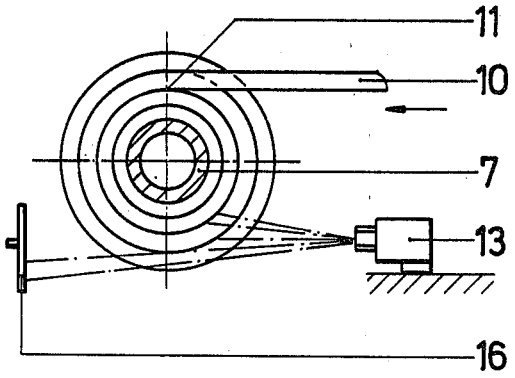
Fig. 5
Fig. 6
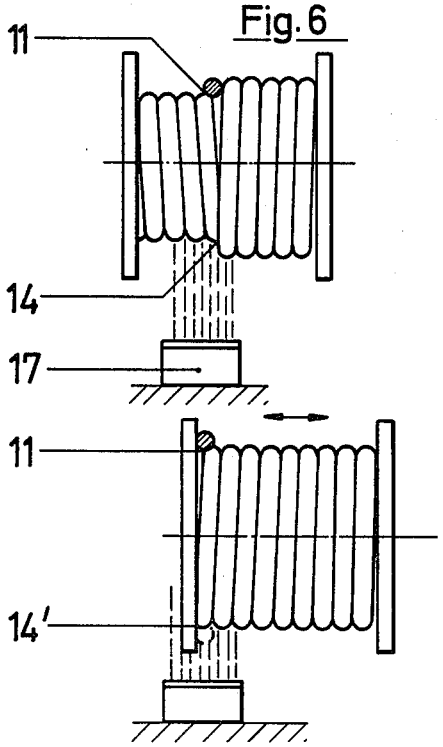
Fig. 7
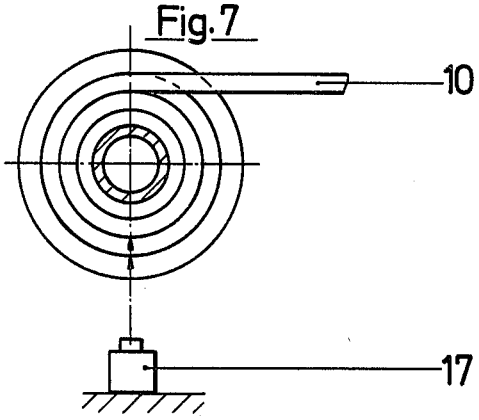
Fig. 8

Fig.9
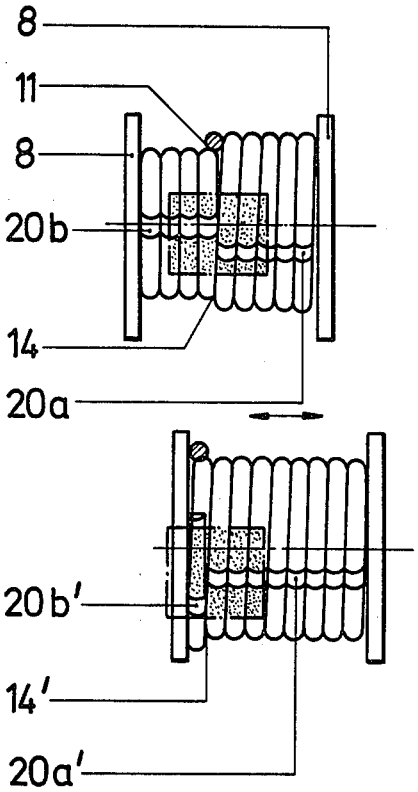
Fig.10
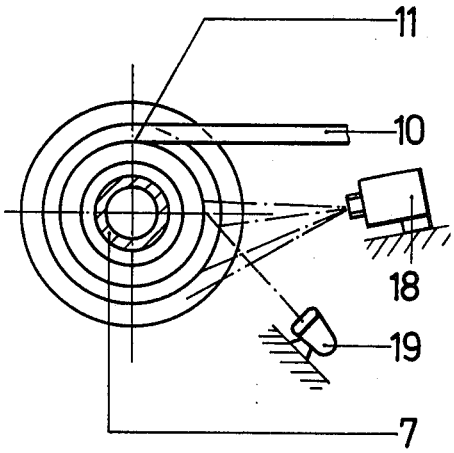
Fig.11

WINDING MACHINE FOR WINDING STRAND-SHAPED WINDING MATERIAL ON A SPOOL

The present invention relates to a winding machine for winding strand-shaped winding material onto a spool to which the winding material is fed via a strand guide (the guide for the material to be wound), the machine having a laying drive for a reciprocating traversing movement of the spool and the strand guide along each other, the drive being controlled upon the rising of the winding material on a spool flange in accordance with a predetermined program during the transition into the next higher winding layer.

If the run-on point of the winding material has reached a spool flange in such winding machines during the development of a winding layer, a number of special laying movements must be carried out in order to obtain a good package and a precise filling out of the remaining gusset space so that a uniform transition into the next winding layer is obtained. Ordinarily the winding material is fed with a hold-back angle (also called a run-on angle) between the two spool flanges in order to assure tight application of the turns. The laying movements are carried out in the known winding machines either by axial traverse of the spool or by traverse of the strand guide parallel to the axis of the spool. One program of laying movements which is commonly carried out (West German Pat. No. 15 74 425) upon arrival of the run-on point of the winding material at a spool flange consists of:

(1) parallel pulling of the winding material to the flange for a given spool rotation until the building up of the first turn of the next winding layer, (2) pulling the winding material away from the flange in order to prevent a climbing of the turns on the flange into the second layer above, (3) after a given further rotation of the spool, swinging back the winding material in order to set the desired hold-back angle for the winding in the next winding layer.

For proper laying it is of decisive importance to be able reliably to note the arrival of the run-on point at a flange or the rising of a new winding layer at the flange so that the program to be then carried out is started always at exactly the correct time.

From West German Pat. Nos. 15 74 425 and 19 02 722, winding machines with a traversing drive for the spool are known in which limit switches for detecting the end positions dependent on the length of the spool are arranged on the frame of the winding machine, these switches controlling the course of the laying movements upon transition to a next winding layer in combination with other limit switches which are controlled as a function of the arrival angle of the winding material. The detection there and control of the laying drive upon transition into the next winding layer is, however, expensive from a structural standpoint and requires precise mechanical adjustments. From U.S. Pat. No. 3,951,355 it is known to detect the rise of a new winding layer by means of approach switches which operate without contact. However, they must be lifted from winding layer to winding layer by separate stepping (drive) motors as a result of which the arrangement in that patent is relatively expensive and susceptible to disturbance. West German OS No. 25 56 484 also discloses a cable winding machine in which the rise into a new winding layer is detected by layer sensors which have a swing arm which lies, via a slide shoe, against the winding and can be lifted off from it against spring pressure, an electric signal being given off upon the swinging up of the arms. Such layer sensors with feeler or slide members acting directly on the winding material are, however, frequently unsuitable, are themselves subject to wear and may injure more sensitive winding material.

The object of the present invention is to equip winding machines of the above type with means for detecting the rise of the windings into a winding layer which are of very low price and completely free of disturbance and wear.

This problem is solved in accordance with the invention by an opto-electrical or acousto-electrical scanning device, arranged on the strand-guide side, for monitoring the winding-layer step in the winding contour, which device has a scanning range at least equal to the maximum thickness of the winding of the spool and upon the occurrence of a new winding layer step effects a switching on of the control program for the passage of the winding into the next winding layer.

The present invention offers the decisive advantage that the monitoring of the rising of a new winding layer is now effected from a scanning device which is arranged in a fixed position and which operates without contact like the approach switches of U.S. Pat. No. 3,951,355 but which itself need not be displaced layer by layer. Thus with the device in accordance with the invention all mechanical displacement devices which are subject to wear are done away with. In addition to this, the scanning device of the invention does not require adjustment on each occasion to the diameter of the winding material or to the width of the spool. In the type of winding machines in which the spool carries out the traversing movement, the scanning device is arranged fixed in position, preferably on the strand guide. On the other hand, if the strand guide carries out the traversing movement then the scanning device of the invention is arranged rigidly on the strand guide since it then must participate in the traversing movements.

In accordance with one preferred embodiment of the invention, the scanning device can be switched into readiness to detect a new winding layer step by the disappearance of the winding layer step observed during the formation of a winding layer. As a result of this measure encroachments into the field of observation of the scanning device during the normal winding process have no effect as long as the normal winding layer step can still be observed.

The fact that a flange enters into the field of observation at the end of a winding layer thus also is without effect. Only after the observed winding layer step has disappeared in the last winding layer after the application of the last winding, is the scanning device again sensitized so as to detect a new change. In this situation, the next change to be expected is the rising of the first winding of the new winding layer so that the reversal program for the transition into the next winding layer is brought about only upon the detection of this process. In this way there is achieved a very reliably operating reversal of the winding process, which is substantially free of disturbing influences, upon transfer into the next higher winding layer, which represents a substantial step forward towards the goal of complete automation of such winding processes.

In accordance with the present invention, the scanning device may be a television camera which is directed tangentially to the winding package. Alternatively, in accordance with the invention a scanning device may comprise remote sensors, for instance ultrasonic sensors, directed radially to the spool. Finally, in accordance with the invention the scanning device may also comprise a television camera which is directed radially onto the spool and a light projector inclined thereto which illuminates the spool with a band of light which extends over the winding-material run-on region.

The invention will be explained in further detail below with reference to various illustrative embodiments shown in the drawing, in which:

FIGS. 3, 4 and 5 are front, side and front views respectively of a spool with winding which serve to explain an opto-electrical winding sensing device;

FIGS. 6, 7 and 8 are front, side and front views respectively of a spool with winding which serve to explain an acousto-electrical winding scanning device; and FIGS. 9, 10 and 11 are front, side and front views respectively of a spool with winding which serve to explain another embodiment of an opto-electrical winding scanning device.

Figure 1:
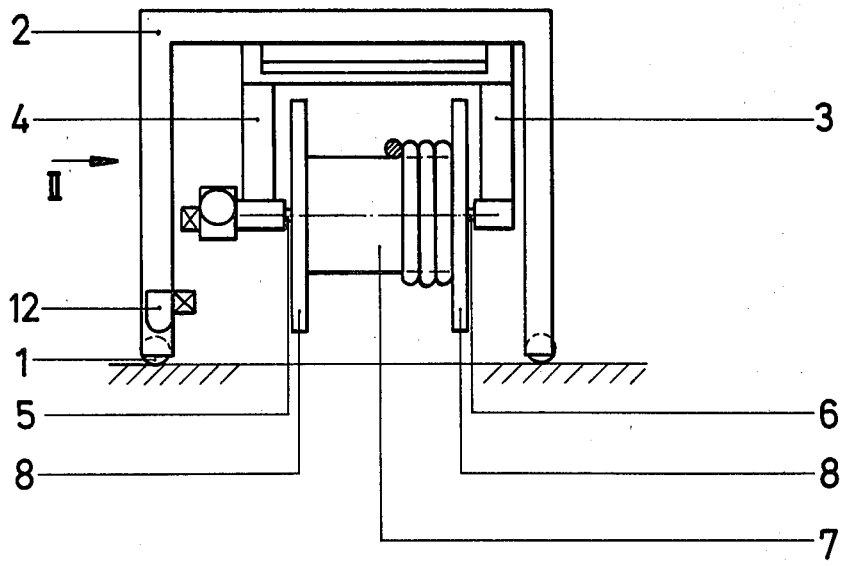
FIG. 1 is a front view of a winding machine in accordance with the invention.
Figure 2:
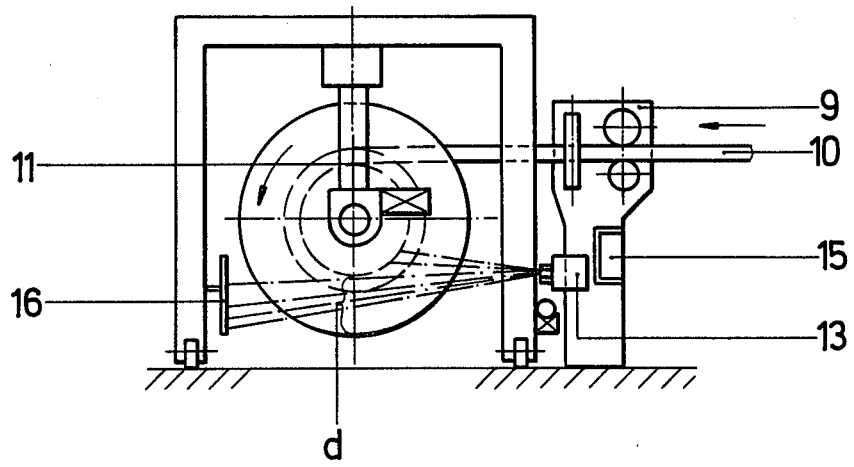
FIG. 2 shows a side view of the winding machine of FIG. 1 seen in the direction of the arrow II.

FIGS. 1 and 2 show a winding machine having a four-leg frame 2 which is movable on rollers 1 and from the upper part of which there are suspended two spindle sleeve arms 3, 4, a spool 7 having flanges 8 being received on the lower spindle sleeves 5, 6. By means of a strand guide 9 which is arranged in fixed position, a strand-shaped winding material 10 which is to be wound with closely adjacent turns and winding layers arranged above one another is fed to the spool 7. During the winding process, the winding-material run-on point 11 travels back and forth between the spool flanges 8; in order to obtain a close application of adjacent windings the winding material should travel onto the spool with a constant run-on angle (relative to the axis of the spool). In order to maintain the run-on angle, the winder, in the case of the embodiment shown by way of example, is moved back and forth on ground rails in front of the strand guide 9 by means of a feed drive 12.

FIGS. 3 to 5 show an opto-electrical scanning device 13 in the form of a television or video camera which in this case is directed approximately tangentially to the winding package and has a viewing angle at least equal to the maximum winding thickness d of the spool. The camera is directed to the winding layer step 14 between two successive winding layers, at a point which is 180° away from the winding-material run-on point 11. In the formation of the winding layer shown in FIG. 3, the winding-layer step 14 travels towards the left flange 8 while at the same time the spool 8 or respectively the winder 2 is moved towards the right so as to maintain a constant feed angle for the winding material 10. As soon as the winding step 14 disappears upon the laying of the last turn of this layer, the scanning device 13 is switched into readiness to detect the new winding layer step 14'. As soon as this new winding layer step 14' has been detected, the scanning device 13 emits a signal to a programmed computer 15 which turns on a pre-established reversal program for the traversing drive 12 upon transfer into the next winding layer. For better detection of the winding-material steps, a contrast surface 16 is provided opposite the television camera 13 on the other side of the spool.

The embodiment shown in FIGS. 6 to 8 has an acousto-electric scanning device 17 which is formed, for instance, of ultrasonic sensors which are directed radially toward the winding package and by acoustic reflection detect the existence of the winding layer step 14 and the rising of a new winding layer step 14', the evaluation again taking place in a manner similar to the embodiment shown in FIGS. 3 to 5.

As a further alternative, FIGS. 9 to 11 show an opto-electrical scanning which comprises a television camera 18 directed substantially radially toward the spool and a light projector 19 arranged at an angle thereto, said light projector illuminating the spool 7 over its entire length by a light band **20*a*, 20*b*. As a result of the different alignment of the light projector 19 and camera 18, the light band jumps as far as the camera is concerned, at the step between the two winding layers located one above the other and accordingly the building-up and travel of this step can be precisely followed by the camera 18. When the last winding has arrived at the flange, the light band 20*b* disappears whereby the monitoring device is switched to readiness to then detect the occurrence of the new shifted light-band section 20*b*'**.

I claim:

1. In a winding machine for winding strand-shaped winding material to form a winding on a flanged rotating spool to which the winding material is fed via a strand guide on a side of the spool, having a winding layer feed drive for a reciprocating relative traversing movement axially of the spool between the spool and the strand guide, the feed drive being controlled upon the rising of the winding material at a spool flange in accordance with a predetermined control program during a transition from a winding layer, having a predetermined width when completely formed, into a next higher winding layer, wherein a step is defined between the first mentioned winding layer and the next higher winding layer until the width of the next higher winding layer increases to said predetermined width the improvement comprising, an electrical scanning means arranged on the strand-guide side for monitoring the presence of the winding layer step in a contour of the winding layers, respectively, without physically contacting the winding layer step, as the width of the next higher winding layer increases to said predetermined width and a transition to a successive next higher winding layer occurs, said scanning means having a scanning range at least equal to a maximum winding thickness of the spool, and said scanning means having means for turning on the control program for reversing the movement of the feed drive upon the transition from the first-mentioned winding layer into the next higher winding layer and upon each occurrence of a new said winding layer step.

2. The winding machine according to claim 2, wherein said scanning means includes means for switching itself into readiness for detection of the next higher winding layer step only by disappearance of the first-mentioned winding layer step by virtue of said first mentioned winding layer progressing to said predetermined width which was observed by the scanning means during the formation of said first mentioned winding layer.

3. The winding machine according to claim 1 or 2, wherein said scanning means is a television camera which is directed tangentially to the winding on the spool.

4. The winding machine according to claim 1 or 2, wherein said scanning means comprises remote sensors spaced apart from and directed substantially radially to the spool.

5. The winding machine according to claim 4, wherein said remote sensors are ultrasonic sensors.

6. The winding machine according to claim 1 or 2, wherein said scanning means comprises a television camera which is directed substantially radially to the spool and a light projector means inclined with respect to said camera for applying onto the winding on said spool a light band which extends over a run-on region of said winding material running onto the spool.

7. The winding machine according to claim 1, wherein said electrical scanning means is opto-electrical.

8. The winding machine according to claim 1, wherein said electrical scanning means is acoustic-electrical.

* * * * *

UNITED STATES PATENT AND TRADEMARK OFFICE

CERTIFICATE OF CORRECTION

PATENT NO. : 4,410,147

DATED : October 18, 1983

INVENTOR(S) : Gerhard Seibert

It is certified that error appears in the above-identified patent and that said Letters Patent are hereby corrected as shown below:

Column 4, (Claim 2,) Line 62 "claim 2" should read --claim 1--

Signed and Sealed this

Tenth Day of April 1984

[SEAL]

Attest:

GERALD J. MOSSINGHOFF

Attesting Officer

Commissioner of Patents and Trademarks